US006024588A

United States Patent [19]

Hsu et al.

[11] Patent Number: 6,024,588

[45] Date of Patent: Feb. 15, 2000

[54] MULTI-SOCKET COMPUTER ADAPTER HAVING A REVERSIBLE PLUG

[76] Inventors: I-Ching Hsu, No. 6, Nan-kung Rd.; I-Cheng Hsu, 7F, No. 42, Nan-kung Rd., both of Chungho City, Taipei, Taiwan

[21] Appl. No.: 09/084,198

[22] Filed: May 26, 1998

[51] Int. Cl.[7] ..... H01R 25/02

[52] U.S. Cl. ..... 439/173; 439/652

[58] Field of Search ..... 439/640, 173, 439/638, 651, 652

[56] References Cited

U.S. PATENT DOCUMENTS 2,752,582 6/1956 Cargill ..... 439/652
4,659,161 4/1987 Holcomb ..... 439/652
4,743,999 5/1988 Hames ..... 439/640
5,857,875 1/1999 Hsu et al. ..... 439/652

*Primary Examiner*—Neil Abrams
*Attorney, Agent, or Firm*—Rosenberg, Klein & Lee

[57] ABSTRACT

A multi-socket computer adapter having a trapezoidal shell, a plug alternatively mounted in different orientations on the trapezoidal shell between two reversed directions by removal and reassembly for connection to a power output socket of a computer to receive power supply from the computer, and a plurality of sockets integral with the trapezoidal shell and connected in series to the lug for receiving computer peripheral apparatus, whereby when the computer is turned off peripheral apparatus joined to the adapter lose power.

1 Claim, 5 Drawing Sheets

MULTI-SOCKET COMPUTER ADAPTER HAVING A REVERSIBLE PLUG

BACKGROUND OF THE INVENTION

The present invention relates to a computer adapter having a reversible plug, and more particularly to a multi-socket computer adapter which is designed for connecting a plurality of computer peripheral apparatus to a power outlet socket on a computer.

A regular computer 100 has a connector for receiving a computer monitor 101, and a power output socket for receiving a peripheral apparatus. When several peripheral apparatus for example, a speaker 102 and a modem 103 are used, an extension cable 104 must be used and connected to the power output socket of the computer 100, so that power supply can be simultaneously provided to the computer 100 and the peripheral apparatus. When in use, the computer 100 and the peripheral apparatus must be separately turned on. When not in use, the computer 100 and the peripheral apparatus must be separately turned off. Because various cables are installed, the cables must be arranged in good order.

SUMMARY OF THE INVENTION

According to one aspect of the present invention, the computer adapter comprises a trapezoidal shell, a reversible plug mounted on the trapezoidal shell for connection to a power output socket of a computer to receive power supply from the computer, and a plurality of sockets integral with the trapezoidal shell and connected in series to the plug for receiving computer peripheral apparatus. When the computer to which the computer adapter is connected is turned off, the computer peripheral apparatus which are connected to the computer adapter are simultaneously turned off. According to another aspect of the present invention, the plug is adjustably fastened to the trapezoidal shell between two alternative positions.

DETAILED DESCRIPTION OF THE PREFERRED EMBODIMENT

Figure 1:
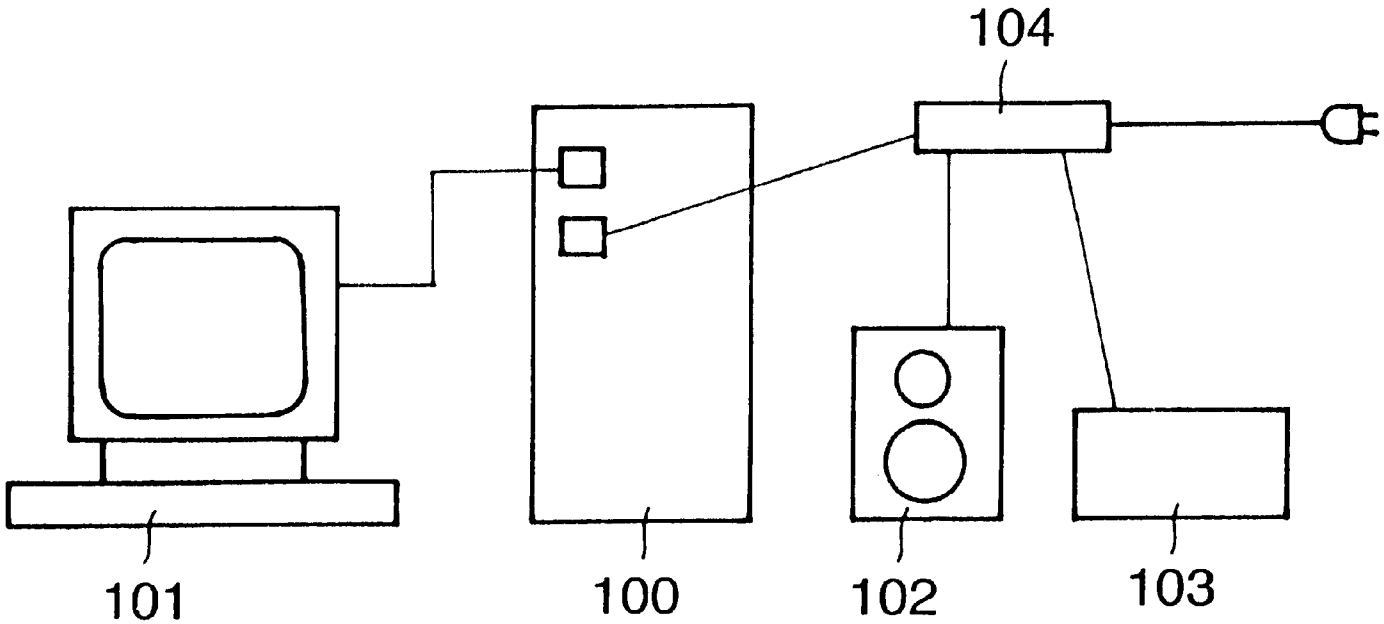
FIG.1 (PRIOR ART)
FIG. 1 shows the power supply arrangement of a computer and a plurality of computer peripheral apparatus.
Figure 2:
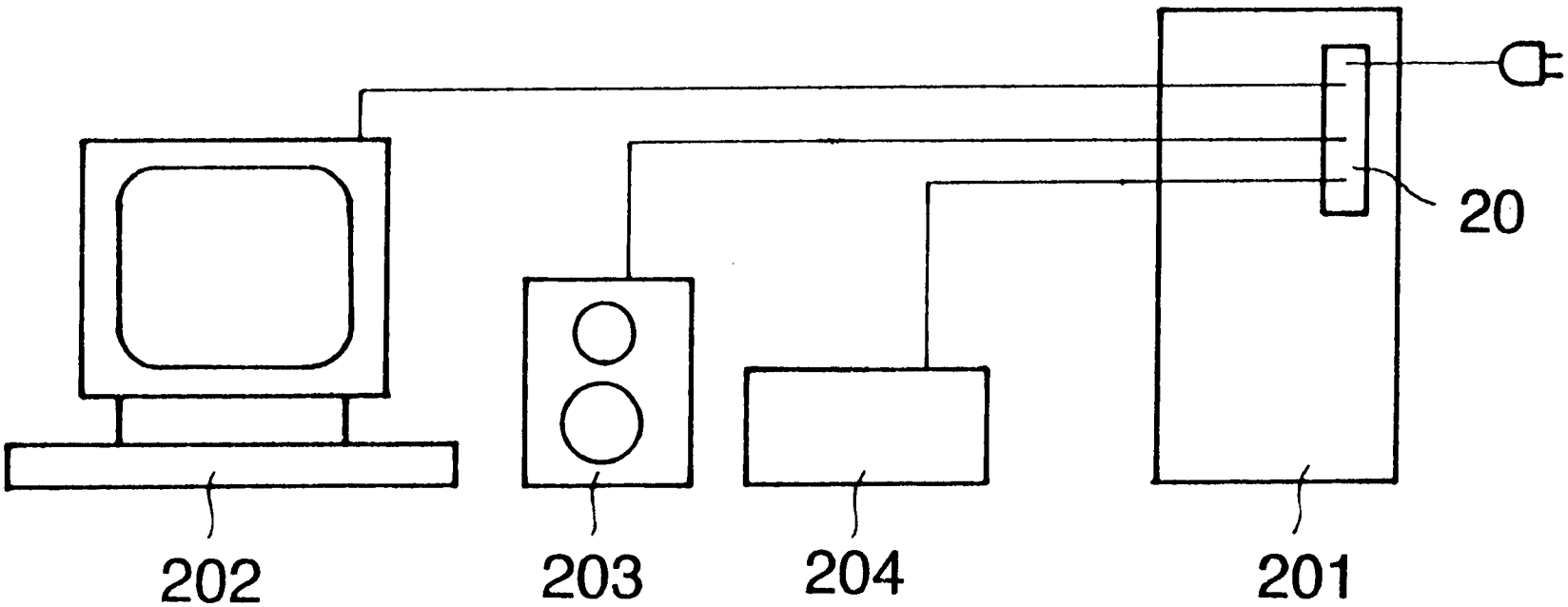
FIG. 2 shows a plurality of computer peripheral apparatus connected to a computer adapter on a computer according to the present invention.

Referring to FIG. 2, a computer adapter 20 is mounted on the back side of a computer 201 and connected to its power supply circuit. The computer adapter 20 receives a variety of peripheral apparatus for example a computer monitor 202, a speaker 203 and a modem 204. The cables of the peripheral apparatus are connected to the computer adapter 20, so that the peripheral apparatus can obtain power supply from the computer 201. When the computer 201 is turned off, the peripheral apparatus which are connected to the computer adapter 20 are electrically disconnected.

Figure 3:
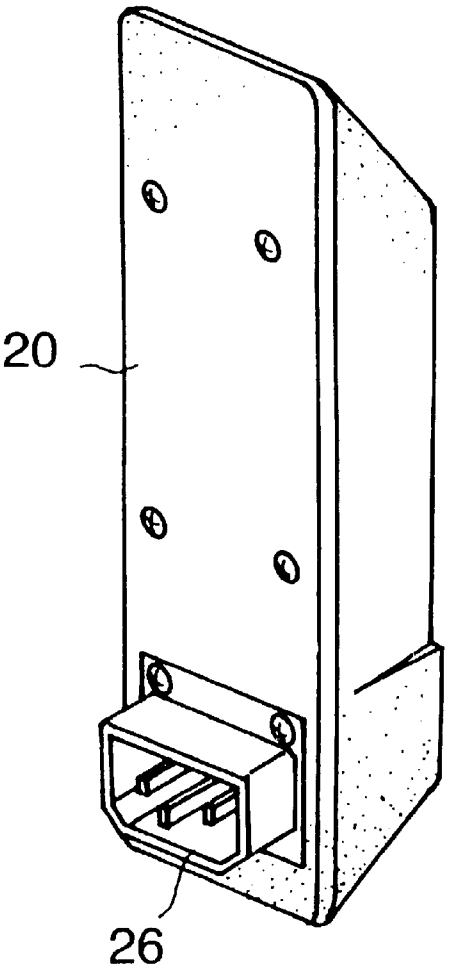
FIG. 3 illustrates the outer appearance of the computer adapter according to the present invention.
Figure 3:
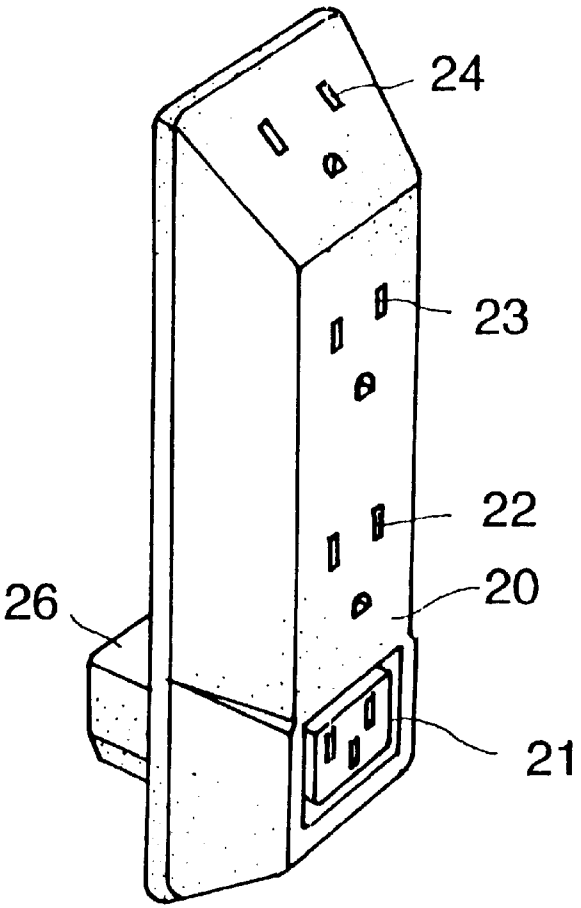
Figure 5:
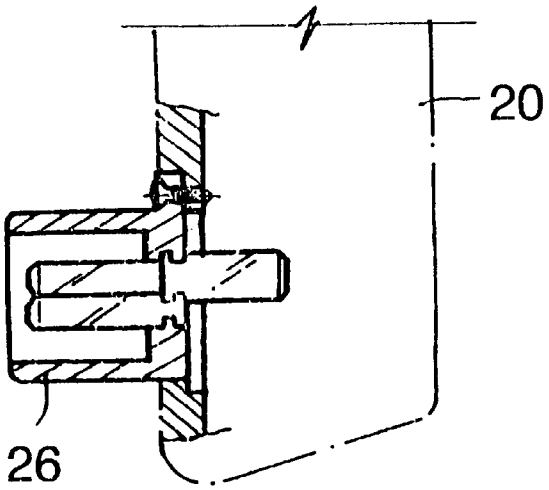
FIG. 5 is a sectional view of a part of the computer adapter according to the present invention.
Figure 4:
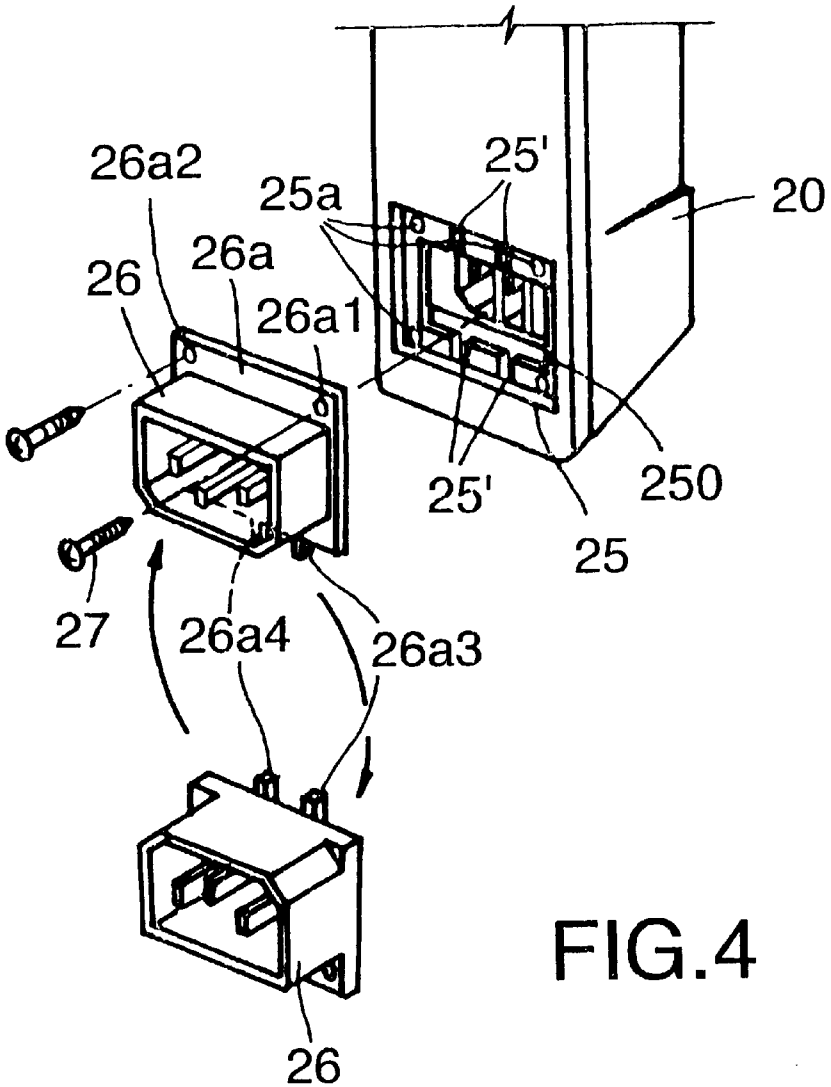
FIG. 4 is an exploded view of the computer adapter according to the present invention.

Referring to FIGS. 3, 4 and 5, the computer adapter 20 is comprised of a plurality of electric connectors integral with one another. The shell of the computer adapter 20 has a trapezoidal shape. The computer adapter 20 comprises an embedded socket 21 and sets of electric plug holes 22;23;24 connected in series and arranged at the front and top sides for receiving the electric plugs of the cables of different computer peripheral apparatus, and a reversible plug 26 at the back side for connecting to a power socket at the back side of a computer. The shell of the computer adapter 20 comprises a square back hole 25, a step 250 defined within the square back hole 25 around the border, four mounting holes 25*a* respectively disposed in the four corners of the step 250, and two pairs of locating notches 25' symmetrically disposed at top and bottom sides of the step 250. The plug 26 comprises a mounting plate 26*a*, which fits the square back hole 25 of the computer adapter 20. The mounting plate 26*a* comprises two mounting holes $\mathbf{26}a_1$;$\mathbf{26}a_2$ and two mounting rods $\mathbf{26}a_3$;$\mathbf{26}a_4$ respectively disposed at top and bottom sides thereof. The mounting holes $\mathbf{26}a_1$;$\mathbf{26}a_2$ are respectively fastened to two mounting holes 25*a* on the step 25 by a respective screw 27. The mounting rods $\mathbf{26}a_3$;$\mathbf{26}a_4$ are fastened to one pair of locating notches 25' on the step 260. The plug 26 can be fastened to the square back hole 25 between two positions.

Figure 6B:
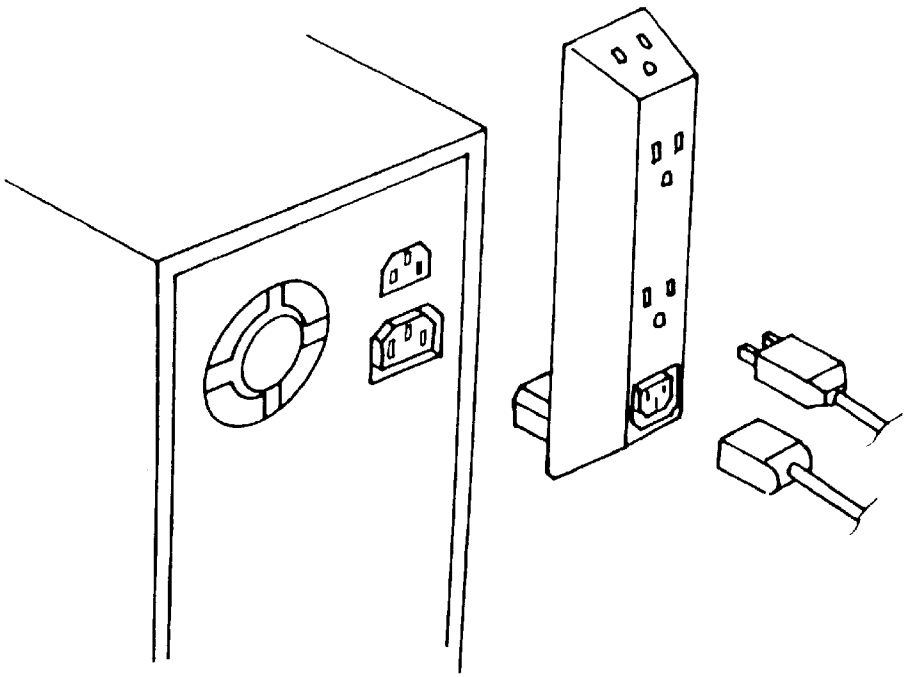
FIG. 6B is another applied view of the present invention.
Figure 6A:
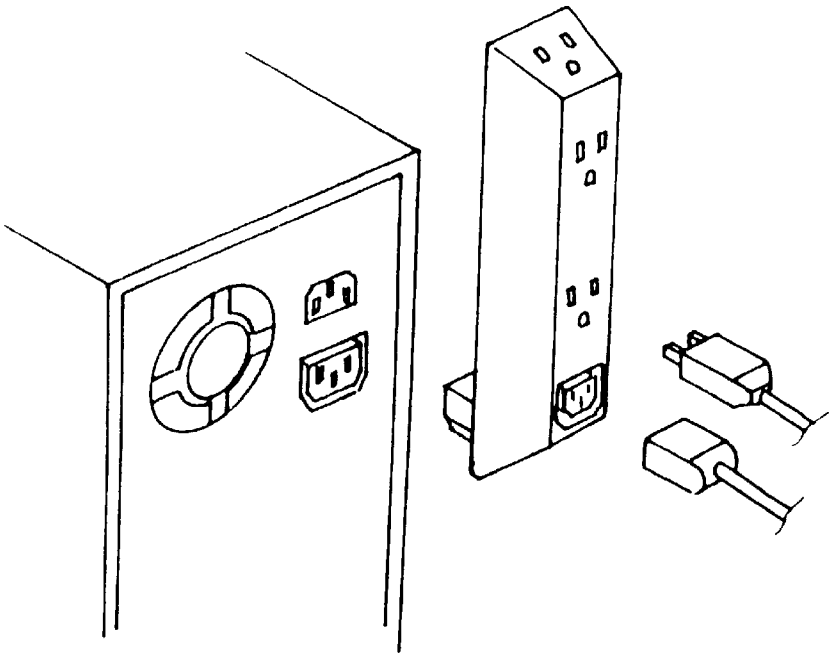
FIG. 6A is an applied view of the present invention.

Referring to FIGS. 6A and 6B and FIG. 4 again, as indicated above, the plug 26 can be fastened to the square back hole 25 on the shell of the computer adapter 20 between two positions, namely, the first position shown in FIG. 6A where the mounting rods $\mathbf{26}a_3$;$\mathbf{26}a_4$ of the plug 26 are fastened to the lower pair of locating notches 25' on the step 260, and the second position shown in FIG. 6B where the mounting rods $\mathbf{26}a_3$;$\mathbf{26}a_4$ of the plug 26 are fastened to the upper pair of locating notches 25' on the step 260.

What the invention claimed is:

1. A multi-socket computer adapter comprising a trapezoidal shell, a plug alternatively mounted on said trapezoidal shell between two reversed directions of substantially 180 degree reorientation for connection to a power output socket of a computer to receive power supplied from the computer, and a plurality of sockets integral with said trapezoidal shell and connected in series with respect to said plug for receiving plugs from computer peripheral apparatus, said trapezoidal shell comprising a square back hole, a step defined within said square back hole, a first pair of mounting holes and a second pair of mounting holes respectively provided at said step at different elevations, a first pair of locating notches and a second pair of locating notches respectively provided a said step at different elevations; said plug comprising a mounting plate fitting said square back hole of said trapezoidal shell, said mounting plate comprising two mounting holes and two mounting rods respectively disposed at top and bottom sides thereof for connection to one pair of said first pair of mounting holes and said second pair of mounting holes and one pair of said first pair and said second pair of locating notches.

* * * * *